US009147921B2

(12) United States Patent
Delgado

(10) Patent No.: US 9,147,921 B2
(45) Date of Patent: Sep. 29, 2015

(54) COMPACT OMT DEVICE

(75) Inventor: Pablo Sarasa Delgado, Paris Cedex (FR)

(73) Assignee: European Space Agency, Paris (FR)

( * ) Notice: Subject to any disclaimer, the term of this patent is extended or adjusted under 35 U.S.C. 154(b) by 526 days.

(21) Appl. No.: 13/514,264

(22) PCT Filed: Nov. 19, 2010

(86) PCT No.: PCT/EP2010/007045

§ 371 (c)(1),
(2), (4) Date: Jul. 11, 2012

(87) PCT Pub. No.: WO2011/069598

PCT Pub. Date: Jun. 16, 2011

(65) Prior Publication Data

US 2013/0120086 A1 May 16, 2013

(30) Foreign Application Priority Data

Dec. 7, 2009 (EP) ..... 09178229

(51) Int. Cl.

| | |
|---|---|
| ***H01P 1/161*** | (2006.01) |
| ***H01P 1/165*** | (2006.01) |
| *H01Q 15/24* | (2006.01) |
| *H01P 1/213* | (2006.01) |

(52) U.S. Cl.

CPC ..... *H01P 1/161* (2013.01); *H01P 1/165* (2013.01); *H01P 1/2131* (2013.01); *H01Q 15/246* (2013.01)

(58) Field of Classification Search

CPC ..... H01P 1/161; H01P 5/02; H01P 1/2131; H01P 1/165; H01Q 15/246

USPC ..... 333/21 A, 21 R, 137, 157; 343/756

See application file for complete search history.

(56) References Cited

U.S. PATENT DOCUMENTS

| | | | | |
|---|---|---|---|---|
| 4,126,835 | A * | 11/1978 | Gould | 333/21 A |
| 6,118,412 | A | 9/2000 | Chen | |
| 2008/0278397 | A1 * | 11/2008 | Rao et al. | 343/779 |

FOREIGN PATENT DOCUMENTS

| | | |
|---|---|---|
| EP | 2 330 681 A1 | 6/2011 |
| JP | 63-099603 | 4/1988 |

(Continued)

OTHER PUBLICATIONS

EP 09 178 229.2—EPO Communication and the extended European Search Report, mail date May 3, 2010, 6 pages.

(Continued)

*Primary Examiner* — Benny Lee
*Assistant Examiner* — Jorge Salazar, Jr.
(74) *Attorney, Agent, or Firm* — Blakely Sokoloff Taylor & Zafman LLP

(57) ABSTRACT

Embodiments are disclosed of an orthomode transducer (OMT) device for splitting a linear orthogonally polarized electromagnetic signal into a plurality of linearly polarized frequency components and vice versa. The device comprises a rectangular or circular guide section having a constant cross-section perpendicular to a lengthwise direction of said guide section and first and second lengthwise opposed open ends, a septum that is successively increased in height; extending from an end of the a waveguide portion towards a second lengthwise open end of the guide section, wherein that the plane of said septum is provided at an angle of 45 degrees relative to the polarization axes of the orthogonal linear polarization modes and said septum induces a differential phase shift of substantially 180 degrees or a multiple thereof between components of the linear polarization modes that are perpendicular to said septum and components that are parallel to said septum.

14 Claims, 7 Drawing Sheets

(56) References Cited

FOREIGN PATENT DOCUMENTS

| | | | |
|---|---|---|---|
| JP | 2002-094301 | | 3/2002 |
| WO | WO 2008/012369 | A1 | 1/2008 |
| WO | WO 2011/069598 | A1 | 6/2011 |

OTHER PUBLICATIONS

PCT/EP2010/007045; International Search Report and Written Opinion of the International Searching Authority, mail date Mar. 9, 2011, 10 pages.

Ihmels, R. et al., "Field Theory Design of a Corrugated Septum OMT," Microwave Symposium Digest, 1993. IEEE MTT-S International Atlanta, GA, USA, Jun. 1993, pp. 909-912.

Chattopadhyay, G. et al., "A 96-GHz Ortho-Mode Transducer for the Polatron," IEEE Microwave and Guided Wave Letters, vol. 8, Issue 12, Dec. 1998, pp. 421-423.

Zhang, Tian-Ling, et al., "A Ka Dual-Band Circular Waveguide Polarizer," National Laboratory of Antennas and Microwave Technology, Propagation & EM Theory, 2006. ISAPE '06. 7$^{th}$ International Symposium, IEEE, PI, Oct. 2006, pp. 1-4.

* cited by examiner

COMPACT OMT DEVICE

CROSS-REFERENCE TO RELATED APPLICATIONS

This application is the U.S. National Stage entry under 35 U.S.C. §371 of international application PCT/EP2010/007045, filed 19 Nov. 2010, which in turn claims priority to European patent application EP 09178229.2, filed 7 Dec. 2009.

FIELD OF THE INVENTION

The present invention relates to a waveguide apparatus for electro-magnetic signal processing and more especially to an apparatus capable of dividing an orthogonally polarized electro-magnetic signal into two linearly polarized signals and, in reverse direction, capable of combining two linearly polarized signals into an orthogonally polarized electro-magnetic signal.

BACKGROUND OF THE INVENTION

In the art of satellite communications, the modern antennas on board of satellites are frequently implemented by an active/passive array of feeds in the focal plane of a reflector system when using orthogonally polarized signals in the feed systems. The cluster of feeds is arranged closely side by side causing implementation problems due to their often complex shape, especially when a great number of feeds are used in a compact configuration. Therefore, the feed waveguide configurations become very intricate and it is important to reduce the size of the feeds in the X and Y axes (with Z being the propagation axis). If the radiating element of the feed is small, the limiting factor that prevents the size reduction is the orthomode transducer (OMT).

The OMT is a waveguide-component capable of dividing an orthogonally polarized electro-magnetic signal into two linearly polarized signals and, in reverse direction, capable of combining two linearly polarized signals into an orthogonally polarized electro-magnetic signal. It is therefore desirable for OMTs used in feed systems comprising a plurality of closely located signal sources to be compact and to have minimum complexity.

Several types of OMT devices are known in the art. Complex OMTs such as coaxial OMTs, Boifot OMTs, orthomode junctions or turnstile junctions offer good bandwidth and/or power handling. However, feed systems using the above types of OMT devices face assembling problems, e.g., due to the need for complicated waveguide networks to recombine all the ports, especially when a great number of signal sources have to be fed and when the sources are close to each other.

A further type of an OMT, a side-coupling OMT, is disclosed in FR 2904478 A1 and by Chattopadhyay et al. in Microwave and Guided Wave Letters, IEEE, Vol 8, Issue 12, December 1998, pages 421-423. This type of OMT apparatus is more compact than the complex OMTs but requires a coupling area with a slot iris of small dimensions that reduces drastically the power handling of the device.

In view of the above problems of the prior art, it is an object of the invention to provide an OMT device that is compact, has a low mass and is cost-efficient to manufacture. It is a further object of the invention to provide an OMT with high power handling capabilities.

SUMMARY OF THE INVENTION

According to an aspect of the invention, an orthomode transducer (OMT) device with a rectangular or circular guide section is proposed, said guide section having a constant cross-section perpendicular to a lengthwise direction of said guide section and first and second lengthwise opposed open ends. An orthomode transducer in the context of this invention is capable of splitting a linear orthogonally polarized electromagnetic signal into a plurality of linearly polarized frequency components and vice versa.

A linear orthogonally polarized electromagnetic signal in the context of this invention comprises two electromagnetic signals with linear polarization orthogonally polarized with respect to each other. In other words, the polarization axes of the linearly polarized signals are orthogonal to each other. Signals with a linear polarization comprise a polarization vector wherein the tip of the vector traces out a single line in the plane, in contrast to signals with a circular polarization.

Splitting in the context of this invention means that the OMT separates a linear orthogonally polarized electromagnetic signal entering the OMT in waveguide portion into two linearly polarized signals that are each comprised in separate waveguide portions (receive path). As an OMT is a passive component, it can be operated in reverse direction, i.e. to combine two linearly polarized signals from separate waveguide portions into a linear orthogonally polarized electromagnetic signal propagating in the same waveguide portion (transmit path). Of course, it is also possible to operate the OMT in both directions at the same time, i.e. using transmit and receive path at the same time with two linearly polarized signals propagating in opposite directions through the OMT.

The OMT device further comprises a first waveguide portion having the same cross-section as said guide section, said first waveguide section being capable of supporting two orthogonal linear polarization modes of signal propagation, and said first waveguide section extending between said first lengthwise open end of the guide section and a septum. The septum of the OMT extends from an end of the first wave guide portion towards the second lengthwise open end of said guide section and divides said guide section into a second waveguide portion and a third waveguide portion having cross-sections smaller than the cross-section of said first wave-guide portion. For minimal power losses, the septum may be a metallic sheet or thin plate. By way of example, the septum may also be a dielectric sheet.

The second waveguide portion and the third waveguide portion are capable of supporting propagation of a linearly polarized signal, i.e., the linearly polarized transverse electric field signal.

According to a further aspect of the invention, said septum is dimensioned as to induce a differential phase shift of 180 degrees or substantially 180 degrees or a multiple thereof between components of the linear polarization modes that are perpendicular to said septum and components that are parallel to said septum. An OMT is usually operated in a given frequency band. For this frequency band, the septum is dimensioned so as to cause a differential phase shift of substantially 180 degrees for the frequencies within this frequency band. As a result, the phase shift in dependence of the frequency follows a curve similar to a parabola with two frequencies within this frequency band having a phase shift of exactly 180 degrees between components of the linear polarization modes that are perpendicular to said septum and components that are parallel to said septum. The phase shift induced by the septum for the frequencies between these two frequencies may be slightly above 180 degrees, whereas the phase shift of the remaining frequencies of the frequency band may be slightly below 180 degrees. By way of example, the phase shift induced by the septum lies within a range of +/−2 degrees of 180 degrees. By way of example, the phase shift induced by a septum according to the invention lies in a small range around 180 degrees for all frequencies of the frequency band that is used for the OMT.

According to a further aspect of the invention, the OMT is used for splitting a linear orthogonally polarized electromagnetic signal into a plurality of linearly polarized frequency components or vice versa, wherein a polarization axis of a linear orthogonally polarized electromagnetic signal entering or exiting the waveguide at said first lengthwise open end may be provided at an angle of 45 degrees relative to the septum. The septum may therefore be provided at an angle of 45 degrees relative to the polarization axes of the linear orthogonally polarized electromagnetic signal.

In other words, a linear orthogonally polarized electromagnetic signal entering the waveguide may be considered to have two orthogonal polarization components. The first of the two orthogonal polarization components enters or exits the waveguide at the first lengthwise open end at an angle of +45 degrees with respect to the plane defined by the septum; the second orthogonal polarization components at an angle of −45 degrees. Thus, each of the two orthogonal polarization components has a field component parallel to the septum and one perpendicular. For signals with a linear polarization, these field components are in phase. The length and the shape of the septum is chosen to cause a 180 degree phase shift between the field component parallel to the septum and the field component perpendicular to the septum.

According to a further aspect of the invention, said septum of the OMT may extend with increasing height from an end of the first wave guide portion towards the second lengthwise open end of said guide section. In other words, the height of the septum may be successively increased. Thus, in addition of the 180 phase shift between the field component parallel to the septum and the field component perpendicular to the septum, the septum causes the field component parallel to the septum, i.e., parallel to the longitudinal axis of the septum, to rotate along the septum until the component initially parallel to the septum has become perpendicular to the septum.

As consequence, at the end of the septum, both field components add together on one side of the septum and cancel on the other. In other words, they are recombined either in the second or third wave guide portion depending on the incoming polarization. Thus, the OMT divides an orthogonally polarized electro-magnetic signal into two linearly polarized signals wherein the second and third wave guide portions which are isolated from each other at the end of the septum each comprise either the first polarization component or the second polarization component depending on the incoming polarization.

The OMT device of the present invention has a compact configuration which embodies a waveguide able to extract or combine two orthogonal linear polarizations with a single integrated septum. Thus, no resonant structures such as irises or metallic slots are required to split orthogonal polarizations. It is also an advantage that the entire phase shift effect is caused by a single component with increasing height that causes at the same time the phase shifting effect and separates the waveguide section into the second and third waveguide section for the propagation of the splitted signals. As a consequence, the compact OMT device has a high power handling and is cost-efficient to manufacture. Furthermore, the waveguide access of the compact OMT is perfectly parallel enabling an easy and very compact assembly of multi-feed arrays in contrast to conventional OMT devices with perpendicular waveguide access.

In order to optimize the power handling of the OMT device, the septum may be positioned in the middle of two opposite elongated walls of the rectangular waveguide resulting in parallel second and third waveguide sections with the same cross-section.

According to a further aspect of the invention, the septum may comprise at least a step-shaped portion. A septum with a step-shaped portion causes the field component parallel to the septum to rotate along the septum and at the same time is cost-efficient to manufacture. Alternatively, the septum may comprise at least a concave-shaped portion. According to a further aspect of the invention, the septum may comprise a combination of step-shaped and concave-shaped portions. The form of the septum as a thin metallic sheet which is successively increasing in height along the longitudinal axis of the waveguide induces the required phase shift and causes only minimal power handling losses. The invention is not restricted to a particular shape of a septum. The length, width, height of septum all influence that phase shift induced by the septum. Thus, by way of example, the septum width may also increase over the length of the septum, e.g. the width of the septum may also comprise a step-shaped portion as long as the septum induces a substantially 180 degree phase shift.

For an efficient coupling of an orthogonally polarized electro-magnetic signal into the waveguide, a circular access may be coupled to an open end of the first wave guide section.

According to a further aspect of the invention, a feed array assembly for an antenna system is proposed comprising a plurality of OMTs of the invention. Preferably, the guide sections of a feed array assembly of the plurality of orthomode transducers of the invention may be arranged in parallel. Since the OMTs have a parallel waveguide access and do not require perpendicular waveguide components, a high number of feeds can be assembled in a very compact configuration. In order to a achieve a highly compact configuration, the OMTs may be assembled to a feed array such that corresponding center points of the guide sections or the longitudinal wave guide axes of three adjacent orthomode transducers are equidistant.

The advantages of the invention can be summarized as follows:

The compact OMT offers a compact size in the X and Y axis (with Z being the propagation axis). The compact OMT is cost-efficient to manufacture, as standard milling or spark erosion in aluminum could be used. The compact OMT is a high power handling solution, because it requires no coupling slots or metallic poles which would drastically increase the multipaction risk in the areas where they are located. Furthermore, the electric field inside a component rotates making a multipactor breakdown very difficult to take place. The compact OMT is a low-loss waveguide component, as the waveguide paths are minimal and there are no lossy waveguide recombination networks with magic-tees, bends. The two waveguide port access of the compact OMT are completely parallel, no waveguide twists and bends were necessary, which not only would increase the mass, but in addition would additionally degrade the insertion and return loss. The feeder waveguides that link the antenna to the repeater are easy to accommodate. Finally, the compact OMT is a low-mass solution. A component is made by a square waveguide with a stepped metallic septum in the middle which advantageously results in a very low-mass device.

The invention is explained below in an exemplary manner with reference to the accompanying drawings, wherein

DETAILED DESCRIPTION

Figure 1:
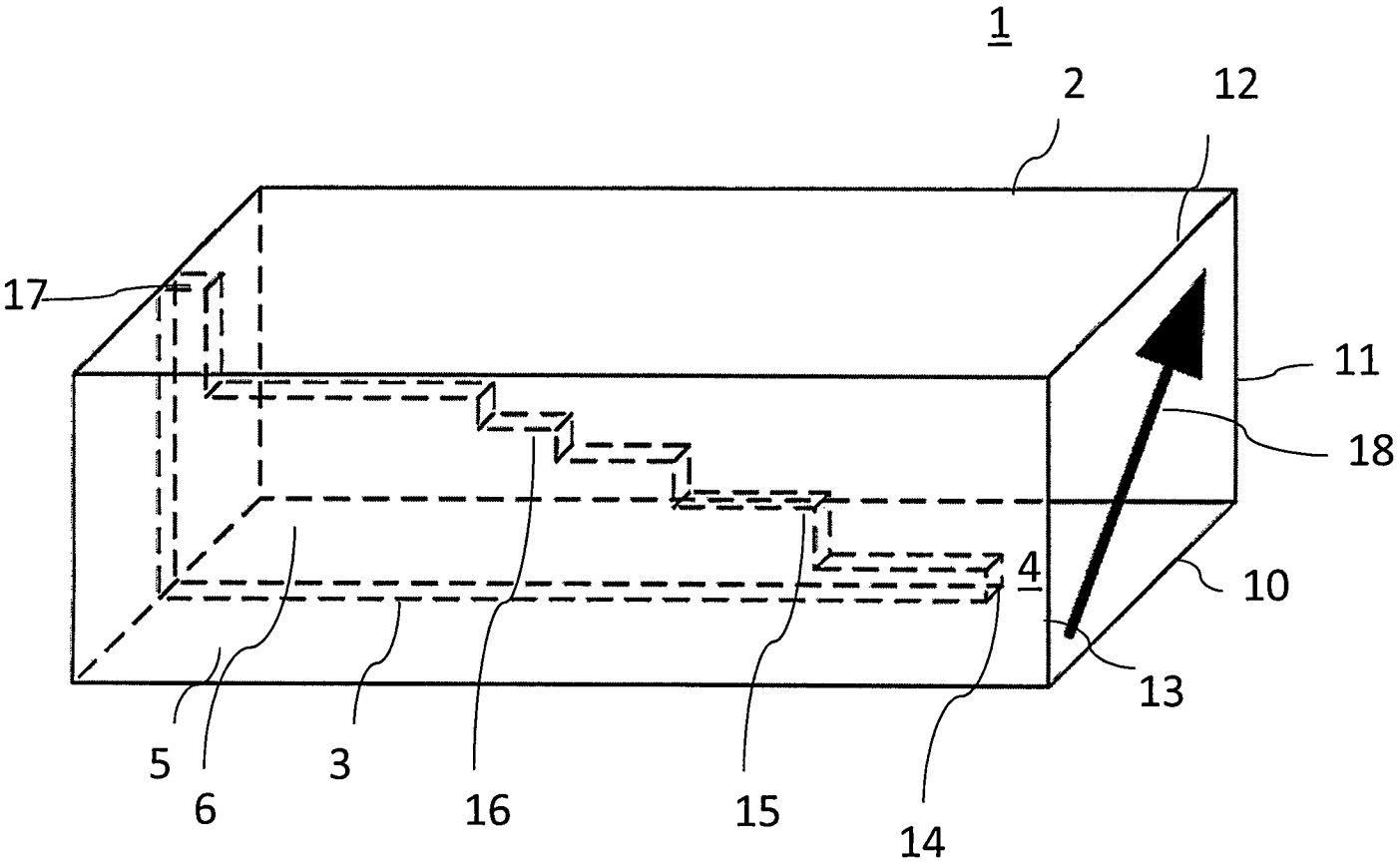
FIG. 1 illustrates a perspective side view of a compact OMT according to an embodiment of the invention.

FIG. 1 illustrates a perspective side view of a compact OMT according to an embodiment of the invention. In the exemplary embodiment depicted in FIG. 1, the orthomode transducer 1 comprises an elongate piece of a hollow electrically conductive waveguide 2 having a square cross-section. The four walls of the waveguide are designated 10, 11, 12, and 13, as shown. A thin elongated electrically conductive septum 3 extends along the longitudinal axis of the compact OMT and forms a plane that is situated halfway between walls 11 and 13. This particular septum 3 has a step-shaped portion causing the septum 3 to be successively increasing in height between the walls 10 and 12.

The waveguide portion between a first open end of the waveguide (indicated by the black arrow in FIG. 1) and the starting point 14 of the septum form the first waveguide portion 4 that has the same cross-section as the guide section 2. The cross-section of the first waveguide portion 4 (which is the corresponding section of the waveguide 2) is so dimensioned as to support two orthogonal polarization modes of signal propagation with horizontal and vertical electric field, respectively, e.g. the TE01 and TE10 modes.

The septum 3 further divides the guide section 2 into a second waveguide portion 5 and a third waveguide portion 6 located on opposing sides of the septum each with almost half the cross-section than the first waveguide portion 4. Due to the width of the septum, the second and third waveguide portions have a cross-section that is slightly smaller than half the cross-section of the first waveguide portion 4. The cross-sections of the second and third waveguide portion 5 and 6 are so dimensioned as to support the propagation of signals with a linear polarization.

The direction of propagation in FIG. 1, if one is converting a linear orthogonally polarized electromagnetic signal into a plurality of linearly polarized frequency components, is from right to left.

The septum 3 (or the plane defined by said septum) needs to be provided at an angle of 45 degrees relative to the polarization axes of the orthogonal linear polarization modes. One such polarization axis is illustrated by the tilted arrow in FIG. 1. Furthermore, the septum 3 must be of such length and shape as to cause a differential phase shift of substantially 180 degrees or a multiple thereof in one component of the electromagnetic wave relative to the other component (cf. FIGS. 4A and 4B). In other words, the septum requires a substantially 180 degrees phase shift to be accomplished within the waveguide 2 for the chosen frequency band and therefore, the septum 3 cannot be shorter than the waveguide length necessary to obtain the requisite 180 degrees differential phase shift. The phase shift induced by the septum 3 varies with the length of the septum 3. Based on the frequency band within which the OMT is operated and the given dimensions of the waveguide 2, the length and shaped of the septum 3 can be determined using electro-magnetic computer simulation of the compact OMT.

In case of an alternative embodiment using a circular waveguide (not shown) instead of a rectangular waveguide, the four walls of the waveguide would be identical quarter-arc sections of a hollow conductive cylinder.

Figure 2:
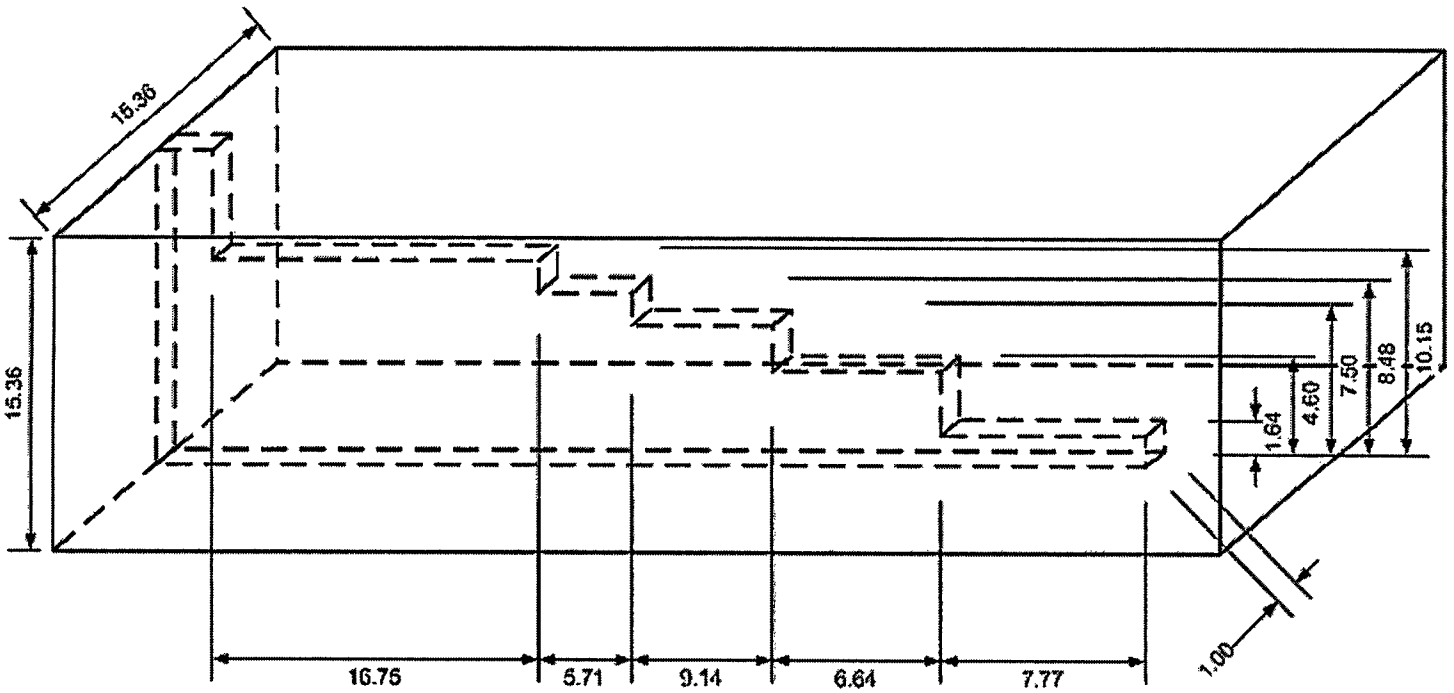
FIG. 2 illustrates a perspective side view of a compact OMT according to an embodiment of the invention.

FIG. 2 illustrates a perspective side view of a compact OMT a shown in FIG. 1 with exemplary measurements. The cross-section of the waveguide 2 are 15.36×15.36 mm, the steps 1-6 of the septum have a length in mm of 7.77; 6.64; 9.14; 5.71 and 16.75 whereas the respective heights in mm of the steps are 1.64; 4.60; 7.50, 8.48; 10.15 and 15.36.

Figure 3:
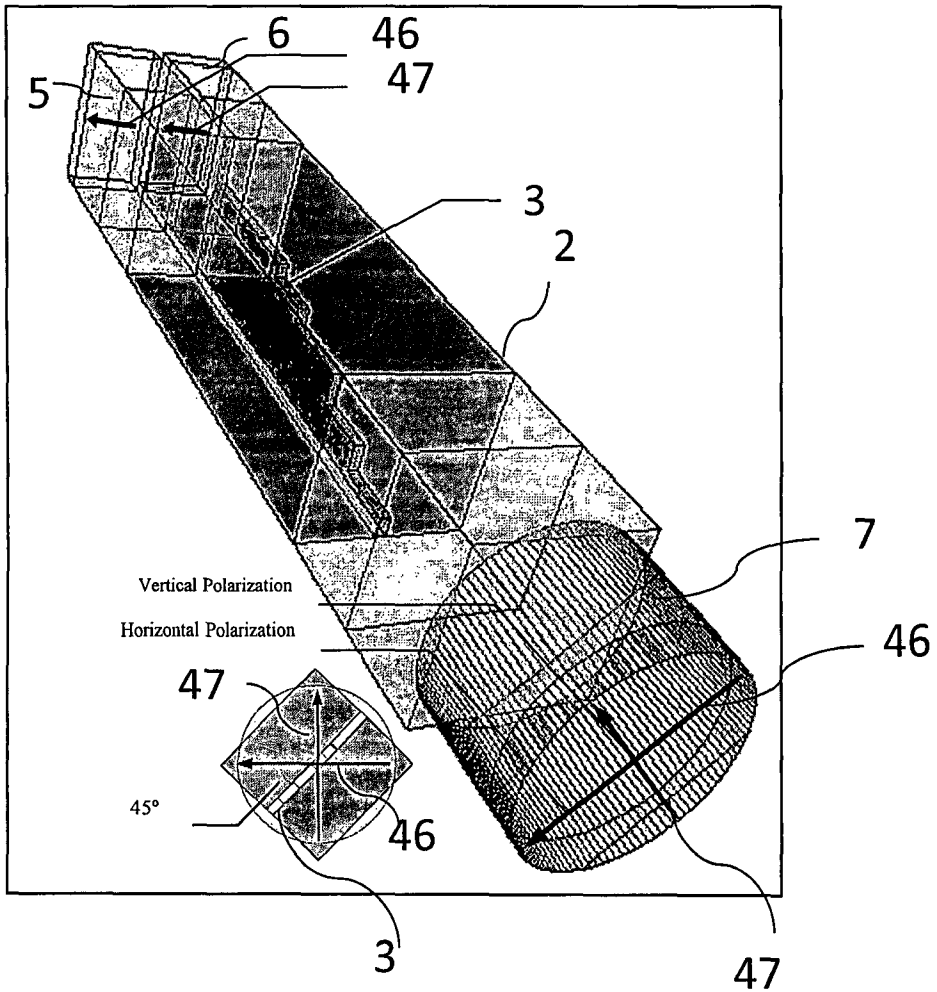
FIG. 3 illustrates schematically a perspective drawing of a compact OMT according to an embodiment of the invention.

FIG. 3 illustrates schematically a perspective drawing of a compact OMT according to an embodiment of the invention. FIG. 3 shows a linear orthogonally polarized electromagnetic signal entering the waveguide with two orthogonal polarization components, a horizontal polarization component 46 and a vertical polarization component 47. One such polarization axis is illustrated by the tilted arrow in FIG. 1. One of two orthogonal polarization components enters or exits the waveguide at the first lengthwise open end at an angle of +45 degrees with respect to the plane defined by the septum 3; the second orthogonal polarization components at an angle of −45 degrees. FIG. 3 further shows a circular access 7 coupled to an open end of the first wave guide section 4. FIG. 3 shows that the OMT divides an orthogonally polarized electro-magnetic signal into two linearly polarized signals wherein the second and third wave guide portions which are isolated from each other at the end of the septum 3 each comprise either the first polarization component 46 or the second polarization component 47 depending on the incoming polarization.

Figure 4A:
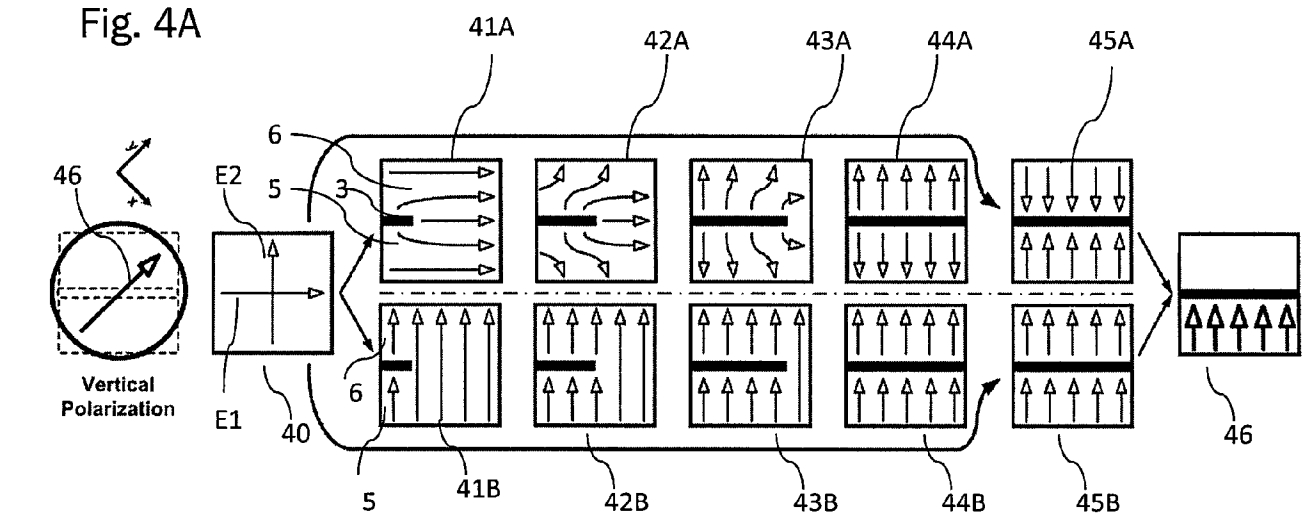
FIG. 4A illustrates the electric field distribution in the compact OMT for the vertical polarization in various planes spaced along and perpendicular to the longitudinal axis of the septum according to an embodiment of the invention.
Figure 4B:
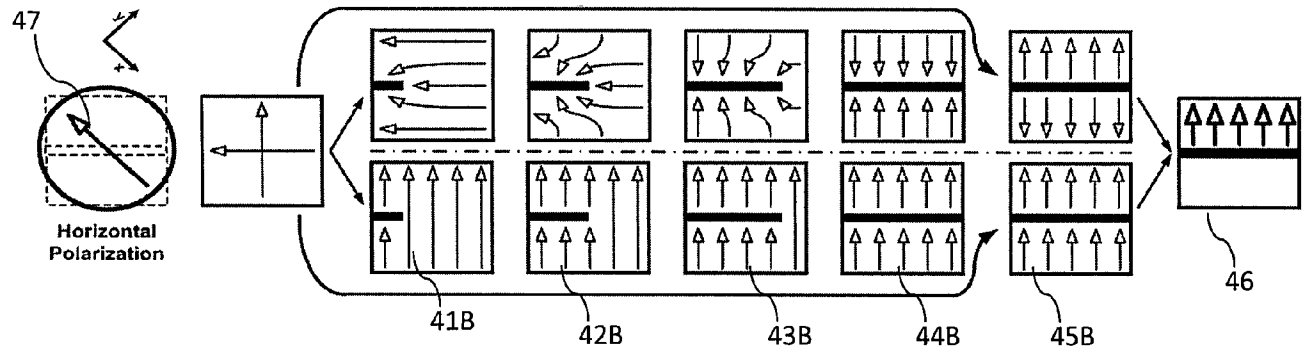
FIG. 4B illustrates the electric field distribution in the compact OMT for the horizontal polarization in various planes spaced along and perpendicular to the longitudinal axis of the septum according to an embodiment of the invention.

The sectional views taken along the longitudinal axis of the waveguide 2 in FIGS. 4A and 4B illustrate the electric field distribution in the compact OMT in various planes spaced along and perpendicular to the longitudinal axis of the septum according to an embodiment of the invention. The incoming signal comprises two linear orthogonally polarized electromagnetic signals 46 and 47. FIG. 4A illustrates the electric field distribution for the vertical polarization 46 and FIG. 4B illustrates the electric field distribution for the horizontal polarization 47. Polarization is defined as the plane in which the electric field, the E-field, varies.

Two orthogonal axes are defined as shown in FIG. 4A and FIG. 4B. The X and the Y axes lie in an angle of 45 degrees relative to the plane of the septum and orthogonally to each other. Additionally, the X axis and the Y axis are orthogonal to a Z axis (not shown) which is the longitudinal axis of waveguide 2 and the septum 3 and represents the direction of propagation of the electromagnetic wave energy.

The septum 3 begins at point 14 and is increasing in height. FIG. 4A shows cross-sections 41A-44A, 41B-44B of a compact OMT of the type illustrated in FIG. 1 at four different points 14-17, i.e. the steps of the septum 3 along the longitudinal axis of the square waveguide 2. The arrows inside the sections show the electric field vectors. Sections 41A and 41B lie in a transverse plane passing through the point 14; sections 42A and 42B, 43A and 43B, 44A and 44B lie in a transverse plane passing through the points 15, 16 and 17, respectively. The first square wave guide portion 4 that is in the portion of the waveguide 2 preceding the septum 3 is to be regarded as transmitting a linear orthogonally polarized signal being propagated away from section 41 and towards section 44.

As illustrated in FIG. 4A, the septum 3 of the compact OMT 1 is placed at exactly 45 degrees with respect to the incoming signals 46 (y-axis) and 47 (x-axis). As a result, one half of the power in the square section will follow the path parallel to the septum 3 and the other half perpendicularly as will be described in the following. The linear orthogonally polarized electromagnetic signals 46 and 47 can be characterized as including orthogonal electric field components $E_1$ and $E_2$, with $E_1$ being the component parallel to the longitudinal axis of the septum 3 and $E_2$ being the component that is perpendicular to $E_1$.

The compact OMT is configured to be used with electromagnetic signals with linear polarization, not circular polarization. Thus, there is a zero degree phase difference between the orthogonal electric field components $E_1$ and $E_2$. The progress of the electric field component $E_1$ through the second and third waveguide sections 5 and 6 is illustrated by the field lines in sections 41A to 44A, whereas the progress of the orthogonal $E_2$ electric field component is illustrated in sections 41B to 44B.

As the $E_2$ electric field component progresses through the second and third waveguide sections 5 and 6, its direction remains unchanged with increasing height of the septum 3 which is illustrated in sections 41B-44B. The $E_2$ component is divided equally by the septum and passes to the two rectangular waveguides 5 and 6. However, as the $E_1$ signal progresses through the second and third waveguide sections 5 and 6, it will rotate smoothly all along the septum 3. The metallic and conductive septum 3 causes the $E_1$ field lines to become parallel with the $E_2$ field lines and to be divided into two portions oppositely directed on opposite sides of the septum 3 in the second and third waveguide sections 5 and 6 as shown in section 44A of FIG. 4A.

However, in addition to the rotating effect, the septum 3 has also phase-shifting effect in that it induces a differential phase shift of 180 degrees of the $E_1$ versus the $E_2$ field components. This effect is not illustrated in the sectional views 41A-44A of FIG. 4A. Instead, this additional effect of the septum is illustrated in section 45A where a 180° phase shift is added to the $E_1$ field lines. Thus, the field lines in section 45A are shifted by 180° compared to the field lines depicted in section 44A. This additional 180° phase shift is induced by the septum while the $E_1$ field lines propagate and rotate along the septum 3. For explanatory purpose, this effect is illustrated separately in section 45A.

Thus, this additional phase shift of 180 degrees inverses the direction of the $E_1$ field so that the $E_1$ field direction in the third waveguide section 6 cancels the corresponding $E_2$ field component in the third waveguide section 6, whereas the field components $E_1$ and $E_2$ in the second waveguide section 5 are additive. As a result, a linearly polarized signal is contained in the second waveguide section 5 as shown in section 46.

FIG. 4B illustrates the same effect for the horizontal polarization. As a result, a linearly polarized signal is contained in the third waveguide section 6 as shown in FIG. 4B.

The compact OMT of the invention is thus capable of splitting a linear orthogonally polarized electromagnetic signal into a plurality of linearly polarized frequency components and vice versa using a single rectangular waveguide 2 with an waveguide access or exit of the splitted linear polarized components that is parallel.

The OMT will also work with any phase shift delay multiple of 180 degrees. However, this will immediately translate in a longer septum and a possible frequency bandwidth reduction.

Figure 5:
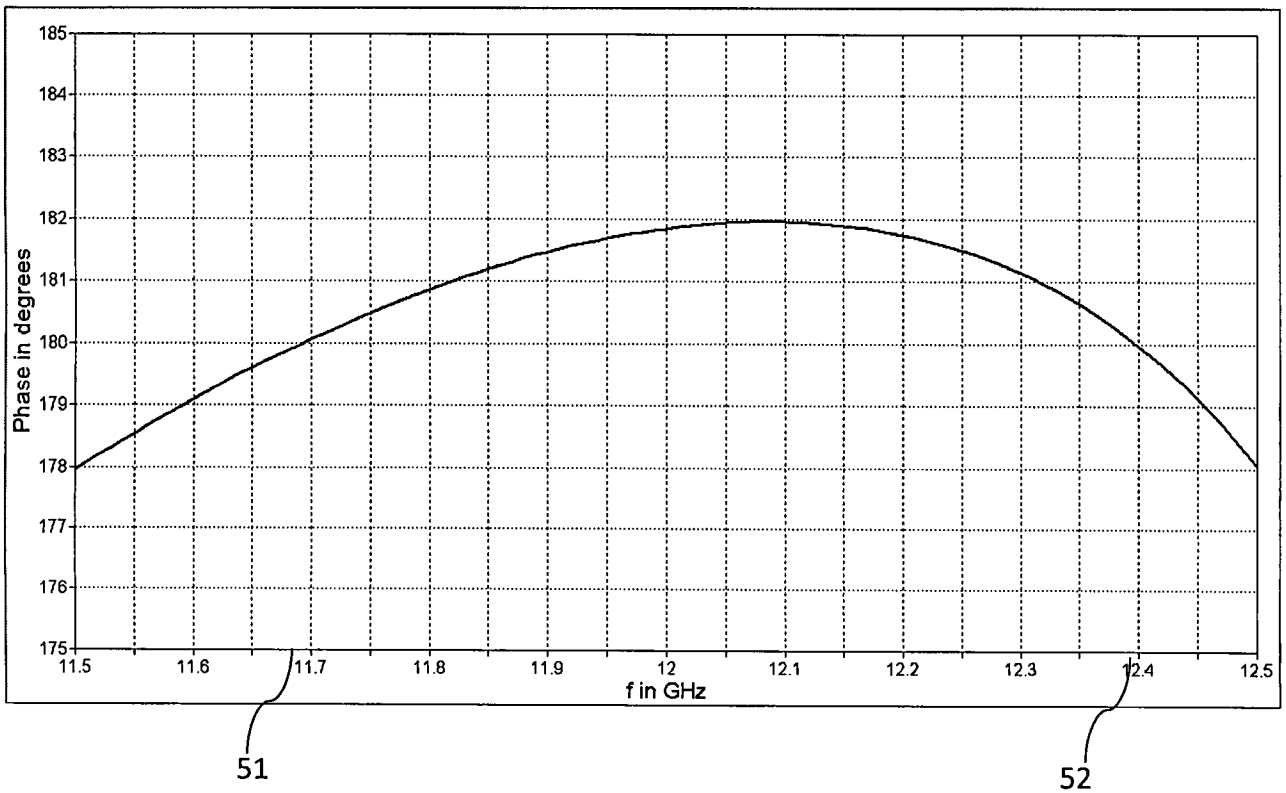
FIG. 5 illustrates the phase shift induced by a septum for the frequencies of the frequency band with which an OMT according to an embodiment of the invention is operated.

FIG. 5 illustrates the phase shift induced by a septum for the frequencies of the frequency band with which an OMT according to an embodiment of the invention is operated. According to this embodiment, the OMT is operated in a frequency band of 11.5 to 12.5 GHz, e.g. which is used for transmissions in telecom satellite applications. The Y-axis of the graph shown in FIG. 5 describes the septum-induced phase shift between the field component parallel to the septum and the field component perpendicular to the septum. As depicted in FIG. 5, the phase shift in dependence of the frequency follows a curve similar to a parabola with two frequencies 51 and 52 within this frequency band having a phase shift of exactly 180 degrees between components of the linear polarization modes that are perpendicular to said septum and components that are parallel to said septum. The phase shift induced by the septum for the frequencies between these two frequencies 51 and 52 is slightly above 180 degrees with a maximum deviation of +2 degrees at 12.08 GHz, whereas the phase shift of the remaining frequencies of the frequency band is slightly below 180 degrees with a maxim deviation of −2 degrees at the borders of the frequency band. Thus, the phase shift induced by the septum is frequency-dependent. The average phase shift induced by the septum is 180 degrees and the deviation from the optimal 180 degrees phase shift lies within a range of +/−2 degrees for the chosen frequency band.

Figure 6:
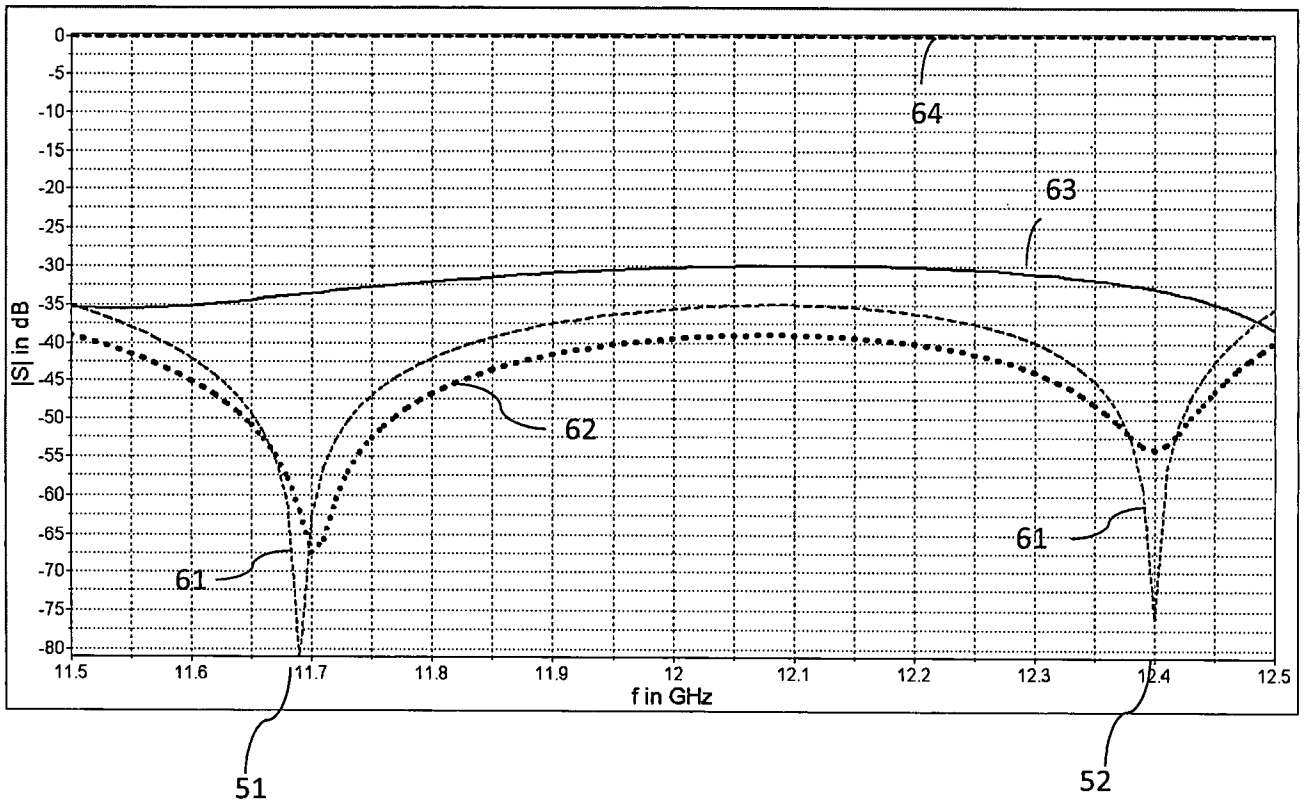
FIG. 6 illustrates computer simulation results of an OMT according to an embodiment of the invention.

FIG. 6 illustrates computer simulation results of an OMT depicted in FIGS. 1-3 with a circular access portion 7 operated in the Ku-frequency band between 11.5 and 12.5 GHz. The lines 61, 62 and 63 measure the return loss, cross-polarization and isolation of the compact OMT in dB for the given frequency band. The lower the dB value, the lower is the undesired "noise" of the compact OMT. The optimal values are achieved for the frequencies 51 and 52 for which a perfect 180 degrees phase shift is induced by the OMT septum.

The continuous line 63 plots the return loss. The worst case value is about −30 dB. This value is the same in the circular common port and in the rectangular one. The return loss achieved with the compact OMT according to this embodiment is excellent compared to return loss of side coupling OMTs known from the art in the same band. Those OMTs side coupling OMTs have only a return loss of about −25 dB in the coupled port.

The dashed line 61 plots the cross-polarization which represents the amount of power that goes from the circular port to the unwanted rectangular port or vice-versa. The cross-polarization of the compact OMT depends on how well the stepped septum shifts 180 degrees. Since 180 degrees cannot be achieved in the entire frequency band, the line 61 shows a cross-polar degradation. The worst case value is about −35 dB. Side coupling OMTs normally have −40 to −45 dB of cross-polarization because there is no need of phase shifting in the component.

The dotted line 62 represents the amount of power that goes from the rectangular port to the other rectangular port. The value obtained is about −39 dB. Other OMTs have a port to port isolation of 50 dB or lower. However, −39 dB of isolation is more than enough for the majority of applications.

Due to the geometrical symmetry of the component, the performances presented in FIG. 6 are identical regardless of the polarization (Vertical or Horizontal). The graphs depicted in FIG. 6 show that the compact OMT works as expected, e.g.

the RF performances are excellent in terms of Insertion (horizontal dashed line 64 at about 0 dB) and Return loss.

Figure 7:
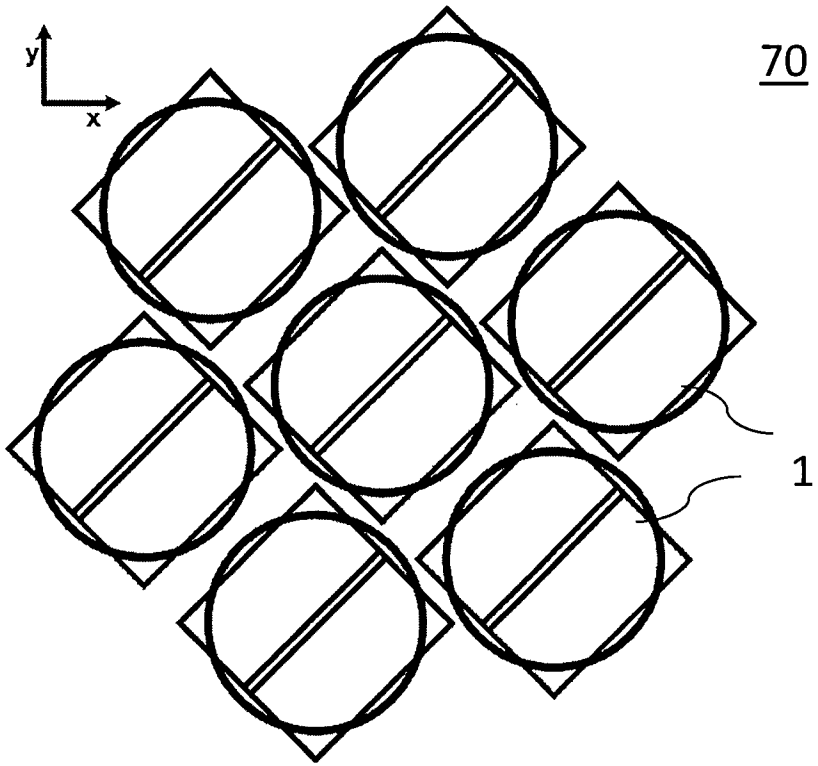
FIG. 7 illustrates an end view of a feed array assembly of orthomode transducers taken along the lengthwise direction of the compact OMTs according to an embodiment of the invention.

FIG. 7 illustrates an end view of a feed array assembly 70 of orthomode transducers taken along the lengthwise direction of the compact OMTs 1 according to an embodiment of the invention. As can be seen in FIG. 5, the compact OMTs 1 with their rectangular waveguide sections 2 having a perfectly parallel waveguide access can be assembled in a very compact and space-saving manner, wherein the OMT waveguides 2 are arranged in parallel. The most compact assembly can be achieved if the corresponding center points of the guide sections or longitudinal axis of the waveguide 2 of three adjacent orthomode transducers are substantially equidistant.

Features, components and specific details of the structures of the above-described embodiments may be exchanged or combined to form further embodiments optimized for the respective application. As far as those modifications are readily apparent for an expert skilled in the art they shall be disclosed implicitly by the above description without specifying explicitly every possible combination, for the sake of conciseness of the present description.

The invention claimed is:

1. An orthomode transducer for splitting a linear orthogonally polarized electromagnetic signal into a plurality of linearly polarized frequency components of the linear orthogonally polarized electromagnetic signal and vice versa, the transducer comprising:

a rectangular or circular guide section having a constant cross-section perpendicular to a lengthwise direction of the guide section and first and second lengthwise opposed open ends; and wherein the guide section further includes a first waveguide portion having the same cross-section as the guide section, the first waveguide section being capable of supporting propagation of the linear orthogonally polarized electromagnetic signal, and the first waveguide section extending between the first lengthwise open end of the guide section and a conductive septum;

the conductive septum extending with increasing height from an end of the first waveguide portion towards the second lengthwise open end of the guide section, the conductive septum dividing the guide section into a second waveguide portion of the guide section and a third waveguide portion of the guide section having cross-sections smaller than the cross-section of the first waveguide portion, the second waveguide portion and the third waveguide portion being capable of supporting propagation of at least one of the plurality of linearly polarized frequency components;

wherein the conductive septum is dimensioned to induce a differential phase shift of substantially 180 degrees or a multiple thereof between the linearly polarized frequency components that are perpendicular to the conductive septum and the linearly polarized frequency components that are parallel to the conductive septum.

2. The orthomode transducer of claim 1 wherein the conductive septum is positioned in the middle of two opposite elongated walls of the rectangular guide section resulting in parallel second and third waveguide portions with the same cross-section.

3. The orthomode transducer of claim 1 wherein the conductive septum includes at least a step-shaped portion.

4. The orthomode transducer of claim 1 wherein the conductive septum is a metallic conductive septum.

5. The orthomode transducer of claim 1 wherein a circular access portion is coupled to an open end of the first waveguide portion.

6. The orthomode transducer of claim 1 wherein the conductive septum is provided at an angle of 45 degrees relative to the polarization axes of the linear orthogonally polarized electromagnetic signal.

7. The orthomode transducer of claim 1 wherein a polarization axis of the linear orthogonally polarized electromagnetic signal entering or exiting the guide section at the first lengthwise open end is provided at an angle of 45 degrees relative to the conductive septum.

8. A feed array assembly for an antenna system, the feed array comprising:

a plurality of orthomode transducers, each orthomode transducer comprising:

a rectangular or circular guide section having a constant cross-section perpendicular to a lengthwise direction of the guide section and first and second lengthwise opposed open ends; and wherein the guide section further includes a first waveguide portion having the same cross-section as the guide section, the first waveguide section being capable of supporting propagation of a linear orthogonally polarized electromagnetic signal, and the first waveguide section extending between the first lengthwise open end of the guide section and a conductive septum;

the conductive septum extending with increasing height from an end of the first waveguide portion towards the second lengthwise open end of the guide section, the conductive septum dividing the guide section into a second waveguide portion of the guide section and a third waveguide portion of the guide section having cross-sections smaller than the cross-section of the first waveguide portion, the second waveguide portion and the third waveguide portion being capable of supporting propagation of at least one of a plurality of linearly polarized frequency components of the linear orthogonally polarized electromagnetic signal;

wherein the conductive septum is dimensioned to induce a differential phase shift of substantially 180 degrees or a multiple thereof between the linearly polarized frequency components that are perpendicular to the conductive septum and the linearly polarized frequency components that are parallel to the conductive septum.

9. The feed array assembly of claim 8 wherein the conductive septum is positioned in the middle of two opposite elongated walls of the rectangular guide section resulting in parallel second and third waveguide portions with the same cross-section.

10. The feed array assembly of claim 8 wherein the conductive septum includes at least a step-shaped portion.

11. The feed array assembly of claim 8 wherein the conductive septum is a metallic conductive septum.

12. The feed array assembly of claim 8 wherein a circular access portion is coupled to an open end of the first waveguide portion.

13. The feed array assembly of claim 8 wherein the conductive septum is provided at an angle of 45 degrees relative to the polarization axes of the linear orthogonally polarized electromagnetic signals.

14. The feed array assembly of claim 8 wherein the guide sections of the plurality of orthomode transducers are arranged in parallel.

* * * * *